US008074992B1

(12) United States Patent
Friedman

(10) Patent No.: US 8,074,992 B1
(45) **Date of Patent: *Dec. 13, 2011**

(54) BAD BEAT BLACKJACK

(75) Inventor: Stacy Friedman, Beaverton, OR (US)

(73) Assignee: Olympian Gaming LLC, Beaverton, OR (US)

( * ) Notice: Subject to any disclaimer, the term of this patent is extended or adjusted under 35 U.S.C. 154(b) by 95 days.

This patent is subject to a terminal disclaimer.

(21) Appl. No.: 12/624,339

(22) Filed: Nov. 23, 2009

Related U.S. Application Data

(63) Continuation-in-part of application No. 11/468,777, filed on Aug. 31, 2006, now Pat. No. 7,651,096.

(60) Provisional application No. 60/713,821, filed on Sep. 1, 2005.

(51) Int. Cl.
*A63F 1/00* (2006.01)

(52) U.S. Cl. ..... 273/292; 292/274; 292/303; 463/13

(58) Field of Classification Search ..... 273/292, 273/309; 463/12, 13
See application file for complete search history.

(56) References Cited

U.S. PATENT DOCUMENTS

| | | | | |
|---|---|---|---|---|
| 6,102,400 | A * | 8/2000 | Scott et al. | 273/269 |
| 6,279,910 | B1 * | 8/2001 | de Keller | 273/292 |
| 7,651,096 | B2 * | 1/2010 | Friedman | 273/292 |
| 2006/0082065 | A1 * | 4/2006 | Falciglia | 273/292 |
| 2007/0075497 | A1 * | 4/2007 | Friedman | 273/292 |

* cited by examiner

*Primary Examiner* — Gene Kim
*Assistant Examiner* — Michael Dennis
(74) *Attorney, Agent, or Firm* — Muskin & Cusick LLC

(57) ABSTRACT

A side wager for blackjack that allows the player to win when the player loses a hand that the player would have expected to win. If the player is initially dealt a good hand, e.g., 20, and the player still loses, then the player can be rewarded by collecting a "bad beat" award.

22 Claims, 2 Drawing Sheets

BAD BEAT BLACKJACK

CROSS REFERENCE TO RELATED APPLICATIONS

This application is a continuation in part (CIP) of U.S. application Ser. No. 11/468,777, filed on Aug. 31, 2006, now U.S. Pat. No. 7,651,096 entitled, "Bad Beat Blackjack" which claims benefit to U.S. provisional application 60/713,821, filed on Sep. 1, 2005, entitled, "A Method for Playing a Side Bet for Blackjack," both applications are incorporated by reference in their entireties for all purposes.

BACKGROUND OF THE INVENTION

1. Field of the Invention

The present inventive concept relates to a casino table game, and more particularly, to a variation of casino blackjack which includes a side wager.

2. Description of the Related Art

Blackjack is a popular casino game, and side wagers related to the relationship of the dealer and/or player cards have been invented. These include the Royal Match bet and the Tie bet. A drawback with other blackjack side wagers is the lack of relevance to the game. For example, there are blackjack side wagers that evaluate certain cards as a poker hand, and while poker is certainly interesting, it and blackjack are unrelated from a gameplay perspective since blackjack evaluates hands based on point totals.

However, table poker is going through an exceedingly popular revival. In poker, a "bad beat" jackpot typically pays a side pot during the play of poker when a player has a good hand but still loses. This can serve to compensate the player for having a good poker hand despite the fact that the player has lost the poker game itself. Bad beat jackpots are usually funded by additional house "rake" from each poker pot. Just like in poker, blackjack players may get upset if they have a good hand (e.g. 20) yet they still end up losing (e.g. the dealer draws to 21).

What is needed, therefore, is a side bet which overcomes the disadvantages in the prior art by incorporating a wagering proposition with relevance to the underlying blackjack game. What is also needed is a way to compensate blackjack players who have a good hand but nevertheless lose, thereby preventing players from becoming frustrating and leaving the game (wherein the casino loses revenue). What is also needed is a way to leverage the existing popularity of poker by providing a poker-like feature within the game of blackjack without neglecting the fundamental properties of blackjack.

SUMMARY OF THE INVENTION

It is an aspect of the present invention to provide exciting variations of blackjack that can be played in casinos.

The above aspects can be obtained by a method that includes (a) in a blackjack game between a player and a dealer, wherein the dealer plays on behalf of a bank of funds, accepting a side wager from the player; (b) dealing to the player initial cards; (c) if the initial cards fail to meet a predetermined criterion, the dealer taking the side wager and adding it to the bank; (d) if the initial cards succeed in meeting the predetermined criterion, completing the blackjack game, which comprises determining a dealer's hand and at least a first player's hand; and (e) paying the side wager from the bank if the dealer's hand beats the first player's hand and if a numeric total of the player's hand falls within a predetermined range of numeric totals.

The above aspects can also be obtained by a method that includes (a) in a blackjack game between a player and a dealer, wherein the dealer plays on behalf of a bank of funds, accepting a side wager from the player; (b) dealing to the player initial cards; (c) if the initial cards fail to meet a predetermined criterion, the dealer taking the side wager and adding it to the bank; (d) if the initial cards succeed in meeting the predetermined criterion, completing the blackjack game by performing the following: (e) determining at least one player's hand, according to the rules of blackjack; (f) associating the side wager and a first player's hand; (g) determining a dealer's hand; and (h) paying the side wager from the bank if the dealer's hand beats the first player's hand.

The above aspects can also be obtained by a method that includes (a) in a blackjack game between a player and a dealer, wherein the dealer plays on behalf of a bank of funds, accepting a side wager from the player; (b) dealing to the player initial cards; (c) determining at least one player's hand, according to the rules of blackjack; (d) associating the side wager and a first player's hand; (e) determining a dealer's hand; and (f) paying the side wager from the bank if each condition in a set of required conditions are met, the set of required conditions comprising: the dealer's hand beats the first player's hand, and a numeric total of the first player's hand falls within a predetermined range of numeric totals.

The above aspects can also be obtained by a method that includes (a) in a wagering game between a player and a dealer, wherein the dealer plays on behalf of a bank of funds, accepting a wager from the player; (b) determining a player's hand and a dealer's hand; and (c) paying the side wager from the bank if each condition in a set of required conditions are met, the set of required conditions comprising: the dealer's hand beats the player's hand, and the player's hand meets a predetermined criterion.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
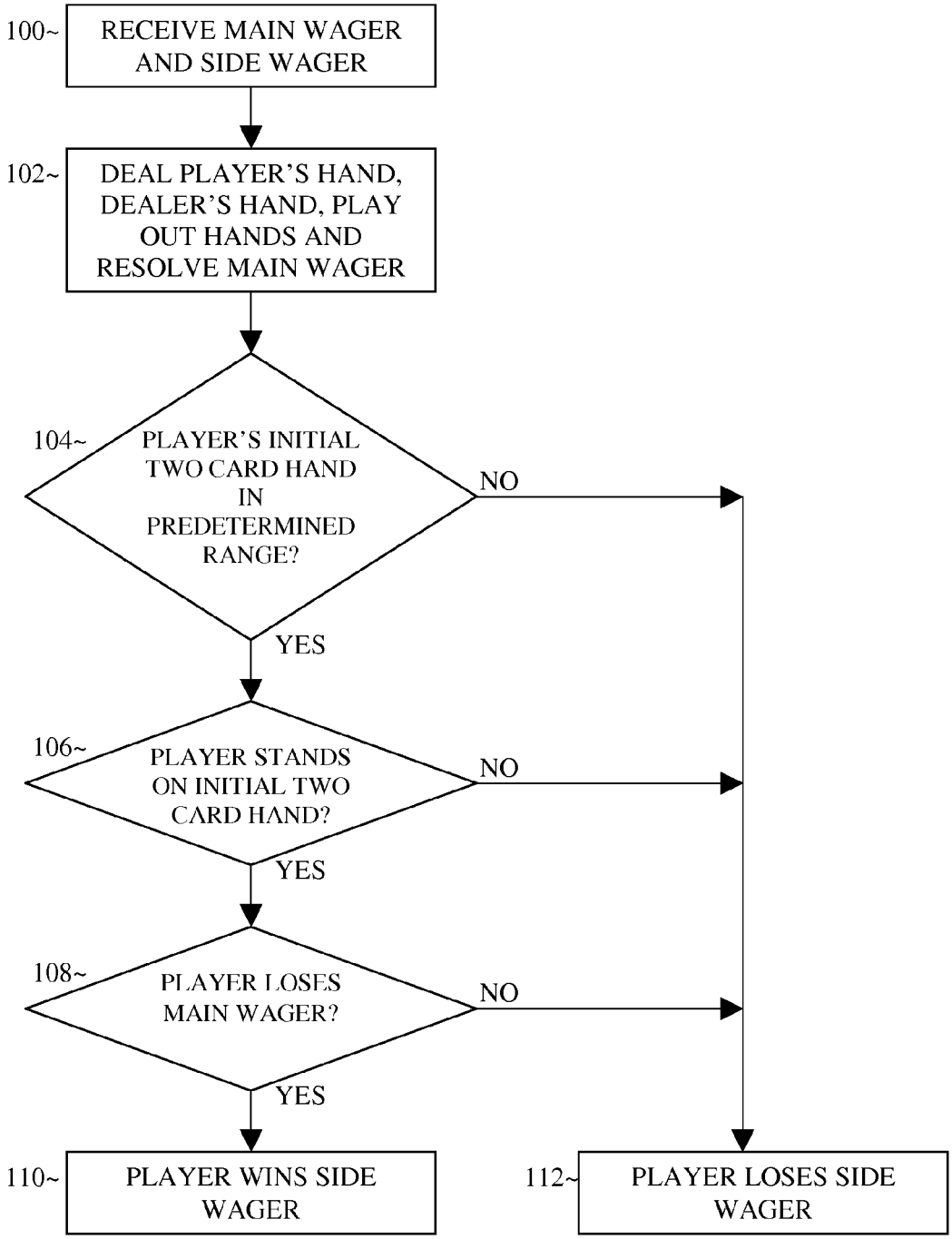
FIG. 1 is a flowchart illustrating an exemplary method of implementing a blackjack side wager which uses the player's initial two card point total only.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer to player(s) a blackjack game which can provide a player with a "bad beat" side wager which can create more excitement than a standard game.

The side wager can reward players in some or all situations in which they "expect" to win after seeing their initial hand (and optionally the dealer's upcard as well), yet they nevertheless end up losing. The bad beat side wager can be optional by the player and placed alongside a main wager (which the player wins if his or her hand beats the dealer's hand and loses if the dealer's hand beats the player's, according to standard blackjack rules). Typically the side wager can any amount, although in an alternate embodiment the side wager must be equal to or less than the main wager.

The bad beat side wager for blackjack is a wager that the following events will occur during the play of a blackjack hand: (1) the player will stand with a total of 17-21 (or any other range), and (2) the dealer's hand will beat the player. If the player does not stand on a total of 17-21, either because they stand on a total less than 17 or because they bust, the player loses the side wager. If the player does stand on a total of 17-21, but the dealer does not beat the player, either by standing on a lower card total, pushing with the player, or busting, the player also loses the wager.

If the player wins the wager, they will win a payout amount N-to-1 on their wager, where N is preferably an integer, but not necessarily. For example, N may be 2 (or 7, 8, 9 or any other number), indicating that the wager will win 2 units for every 1 wagered. However, for example, N may be a non-integer such as 1.5, indicating a 3-to-2 payoff as is typical with a winning natural blackjack hand.

In an alternate embodiment, if the player wins the wager, they will win a payout amount N_i-to-1 on their wager, where N_i is again preferably an integer and each N_i corresponds to a distinct player hand total. For example, N.sub.-20 may be 25 and N.sub.-19 may be 10, indicating that the wager wins 10 units for every 1 wagered if it is won and the player hand totals 19, and that the wager wins 25 units for every 1 wagered if it is won and the player hand totals 20. In a further embodiment, the payouts N_i are related to distinct configurations of player cards which may have the same total. For example, N_(two red kings) may be 100 and N_(Ace and Nine) may be 15, indicating that the wager wins 100 units for every 1 wagered if it is won and the player holds two red kings; and that the wager wins 15 units for every 1 wagered if it is won and the player holds an Ace and a Nine. Thus, the composition of the player's hand (the actual cards held, not just their total) can also affect the payout on a win. The composition of only the player's initial two cards or the composition of the player's final hand (after the player has played out his or her hand) can be used to determine the payout, depending on the embodiment being implemented.

Typically, the side wager would pay an amount such that the loss from the underlying blackjack wager would be entirely offset by the winning amount of a bad beat wager when the bad beat wager has won. However, this cannot be guaranteed under all circumstances.

In a first embodiment, in order for the player to win the side wager, the value of the player's first two cards must be between 17 and 21 (or another range) and the player must stand. Other ranges can be 18-21, 19-21, 20-21, 21, 17-20, 18-20, 19-20, etc.

Additionally, other ranges need not be contiguous, for example a range can be {17, 18, 19, 21}, etc. Additionally, other ranges can be non-uniform and conditional upon the content of the player hand. For example, a range may be (19-21 if the player hand contains an ace but 17-21 if it does not), or (20-21 if the hand contains an ace but 19-21 if it does not), or (17-21 if the player hand does not contain a pair but {17, 19, 21} if it does), etc.

FIG. 1 is a flowchart illustrating an exemplary method of implementing a blackjack side wager which uses the player's initial two card point total only.

The method can start with operation 100, which receives a main wager and a side wager. This is done as known in the art.

From operation 100, the method proceeds to operation 102, which deals the player's hand, the dealer's hand, the player play's out his or her hand, the main wager is resolved. This can be done as known in the art using standard rules such as that found in Las Vegas casinos, (or any non-standard) rules of blackjack. The present inventive concept relates to how the side wager ("bad beat wager") is resolved.

From operation 102, the method can proceed to operation 104, which determines whether the player's initial two card hand falls within a predetermined range. This can be done by summing both player's initial cards. If the player has a "soft" hand (at least one ace), then the total can be computed as if the ace was worth 11 (instead of 1). If the player's initial two card hand does not fall within the predetermined range, then the method proceeds to operation 112, wherein the player loses the side wager.

If the determination in operation 104 determines that the player's initial two cards do fall within a predetermined range, then the method can proceed to operation 106, which determines whether the player stands (or did stand) on his or her initial two card hand (the player's decision to stand or not would typically take place during operation 102). If the player did not stand on his or her initial two cards, then the method proceeds to operation 112, wherein the player loses the side wager.

If the determination in operation 106 determined that the player did stand on the initial two card hand, then the method can proceed to operation 108, which determines whether the player has lost the main wager (this typically would be resolved in operation 102). If the player has not lost the main wager (i.e. the player has won the main wager), then the method can proceed to operation 112, wherein the player loses the side wager.

If the determination in operation 108 determines that the player has lost his or her main wager, then the method can proceed to operation 110, wherein the player wins the side wager. The award for the winning side wager can pay any amount, such as 1:1 of the original side wager placed by the player, or 2:1, or 3:1, etc., optionally including an amount additionally based on the total value of the player's hand or composition thereof. If the player has tied the dealer during operation 102, then the method can proceed from operation 108 to operation 112. In an alternative embodiment, if the player has tied the dealer during operation 102, then the method can proceed from operation 108 to operation 110. In an alternative embodiment, if the player ties the dealer (pushes), then the player does not win or lose the side wager but pushes the side wager.

A number of examples of the method illustrated in FIG. 1 will now be presented. The player makes a bad beat wager and is dealt King-7. The dealer's upcard is a 10. The player elects to stand with a total of 17. The dealer turns over another 10, for a total of 20. The player has lost the blackjack wager but wins the bad beat wager.

As a further example: The player makes a bad beat wager and is dealt 4-4 (the suits are irrelevant here). The player loses the bad beat wager, regardless of whether he wins or loses the original wager. The player stands with a total of 20. The dealer stands on a total of 18. The player wins the blackjack wager but loses the bad beat wager.

As a further example: The player makes a bad beat wager and is dealt a natural blackjack. The dealer also has a blackjack, which ties the player's blackjack. Since the dealer's hand ties the player's hand and the player stood on the first two cards in the range 17-21, the player can win the bad beat wager. In an alternative embodiment, the player can lose the bad beat wager. In an alternative embodiment, the player can push the bad beat wager.

In a further embodiment, the player can be eligible to win the side wager if the player's final point total falls within a range (after the player has played out his or her hand).

Figure 2:
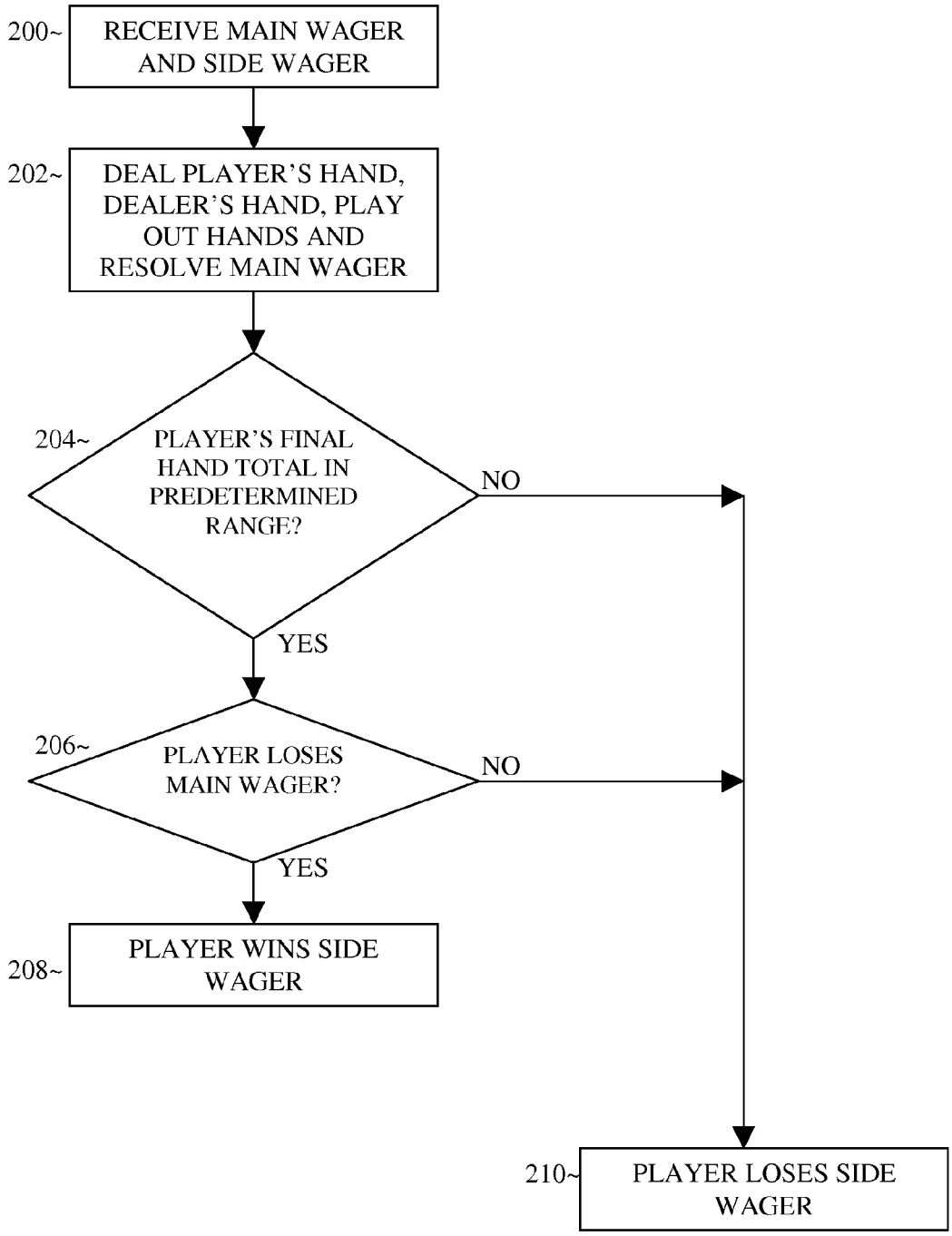
FIG. 2 is a flowchart illustrating an exemplary method of implementing a blackjack side wager which uses the player's final point total.

FIG. 2 is a flowchart illustrating an exemplary method of implementing a blackjack side wager which uses the player's final point total.

The method can begin with operation 200, which receives a main wager and a side wager. This can be performed as known in the art.

From operation 200, the method can proceed to operation 202, which deals the player's hand, the dealer's hand, both the player and the dealer play out their hands, and the main wager is resolved. This is all done as known in the art.

From operation 202, the method can proceed to operation 204, which determines whether the player's final point total falls within the predetermined range (e.g. 17-21 or any other range such as those described previously). If the player's final point total does not fall into this range, then the method can proceed to operation 210, wherein the player loses the side wager.

If the determination in operation 204 determines that the player's final point total falls within the predetermined range, then the method can proceed to operation 206, which determines whether the player loses (has lost) the main wager (typically during operation 202). If the player has won the main wager, then the method proceeds to operation 210, wherein the player loses the side wager.

If the determination in operation 206 determines that the player's final point total falls within the predetermined range, then the method can proceed to operation 208, wherein the player wins the side wager.

It is noted that during operation 206, if the player ties the dealer (pushes), then the method can proceed to operation 210. In an alternative embodiment, if the player ties the dealer (pushes), then the method can proceed to operation 208. In an alternative embodiment, if the player ties the dealer (pushes), then the player does not win or lose the side wager but pushes the side wager.

In the second method illustrated in FIG. 2, the value of the player's final hand after all other strategic choices are made must fall in the predetermined range (e.g. 17-21 or other range) in order for the player to win the side wager.

In the embodiment illustrated in FIG. 2, since the bad beat wager is not resolved based on the first two cards only (as in FIG. 1), it is possible for the player to have split and/or doubled down prior to standing on a total. If the player chooses to split or double down, they are required by the rules of blackjack to increase their wager accordingly. The player may be required (or may not) to similarly increase their bad beat wager proportionally with their blackjack wager, or alternatively that such increase may be optional or alternatively not allowed. In the event of a split hand, and the player has added another bad beat wager in proportion to the underlying blackjack wager, it may be possible for one hand to win the bad beat wager and another to lose.

As an example of the method illustrated in FIG. 2: The player makes a bad beat wager and is dealt 6-2. The player elects to hit, drawing a 10. The player chooses to stand with a total of 18. The dealer stands on a total of 20, so the player loses the blackjack wager but wins the bad beat wager.

As another example of the method illustrated in FIG. 2: The player makes a bad beat wager and is dealt Ace-Ace. This hand is usually split, and the player elects to do so. The player makes an additional, equal value blackjack wager and an additional, equally-valued bad beat wager. In one hand, the player is dealt a 9 and elects to stand with a total of 20. In the second hand, the player is dealt a 6 and elects to hit, and subsequently draws a 10 for a total of 17. The dealer stands on a total of 18. The first player hand wins while the first bad beat wager loses, and the second player hand loses while the second bad beat wager wins.

In a further embodiment, all of the embodiments described herein can be modified so that if the player's hand (either initially as in FIG. 1, or finally as in FIG. 2) does not fall into the range (e.g. 17-21), then the player does not win or lose the bad beat wager. For example, in a modified embodiment of FIG. 1, if the qualifying range is 17-21, and the player is dealt a 10 and 6, then regardless of the player's final hand, and regardless of whether the player wins or loses, the player pushes on the bad beat side wager. If the player is instead dealt a 10 and a 7, and he stays and wins the hand, then the player would lose the bad beat wager. If the player is dealt the 10 and the 7 and stays but instead loses the hand, then the player would win the bad beat wager.

Any embodiments described herein can be played with a standard deck of cards or any type of special deck (e.g. a Spanish deck, etc.) The game can also be played with a single deck or multiple decks (e.g. 1-8 decks or more). Standard Las Vegas rules of blackjack can be used as well as any known variation of blackjack. For example, a standard game of blackjack can utilize 1-8 decks, player can double on any two cards, player can split up to three times (or any amount), blackjack pays 3:2, and dealer hits soft 17 (or stands). Further, the order of any of the operations described herein can be performed in any order and wagers can be placed/resolved in any order. Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An electronic gaming apparatus for playing a blackjack game comprising:

a computer;

a computer readable storage medium;

a source of playing card values;

wherein the computer is configured to execute instructions from the computer readable storage medium to perform the following operations after receipt of a main wager and a side wager from a player:

obtaining two initial playing card values from the source of playing card values;

allowing the player to choose between standing on the two initial playing card values or another option(s);

completing the blackjack game which includes resolving the main wager;

requiring, in order to trigger a winning payout for the side wager, that the player satisfy at least one winning condition in a set of predetermined winning condition (s), wherein a winning condition in the set of predetermined winning condition(s) is that the player chose to stand on the two initial playing card values and a point total of the two initial playing card values falls within a predetermined range and the player loses the main wager, and if the player did satisfy at least one winning condition in the set of predetermined winning condition(s) then paying the player based on the side wager and a fixed paytable;

if the player chose to hit on the two initial playing card values then taking the side wager; and if the player did choose to stand on the two initial playing card values and if the player wins the main wager, then taking the side wager.

2. The electronic gaming apparatus of claim 1, wherein if the player pushes on the main wager then pushing the side wager.

3. The electronic gaming apparatus of claim 1, wherein if the player pushes on the main wager, then paying the player based on the side wager.

4. The electronic gaming apparatus of claim 1, wherein if the player pushes on the main wager, then taking the side wager.

5. The electronic gaming apparatus of claim 1, wherein if the player is paid on the side wager, the payout on the paying is affected by the composition of the player two initial playing card values.

6. The electronic gaming apparatus of claim 1, wherein if the player chooses to split the two initial playing card values during the completing into a first split hand and a second split hand then the main wager and side wager associate with the first split hand, and wherein another winning condition in the set of predetermined winning condition(s) is that the player chose to split on the two initial playing card values, the player chose to not hit on the first split hand, a point total of the first split hand is within the predetermined range and the player loses the main wager.

7. An electronic gaming apparatus for playing a side wager in a blackjack game comprising:

a computer;

a computer readable storage medium;

a source of playing card values;

wherein the computer is configured to execute instructions from the computer readable storage medium to perform the following operations after receipt of a side wager from a player:

obtaining two initial playing card values from the source of playing card values;

allowing the player to choose between standing on the two initial playing card values or another option(s);

completing the blackjack game which includes determining a player hand and a dealer hand;

requiring, in order to trigger a winning payout for the side wager, that the player satisfy at least one winning condition in a set of predetermined winning condition (s), wherein a winning condition in the set of predetermined winning condition(s) is that the player chose to stand on the two initial playing card values and a point total of the two initial playing card values falls within a predetermined range and the dealer hand beats the player hand; and if the player did satisfy at least one winning condition in the set of predetermined winning condition(s), then paying the player an award based on the side wager and a fixed paytable.

8. The electronic gaming apparatus of claim 7, further comprising determining if the player chose to stand on the two initial playing card values and the point total of the two initial playing card values falls within the predetermined range and the player hand beats the dealer hand, and if so, then pushing the side wager.

9. The electronic gaming apparatus of claim 7, wherein another winning condition in the set of predetermined winning condition(s) is that the player chose to stand on the two initial playing card values and the point total of the two initial playing card values falls within the predetermined range and the player hand beats the dealer hand.

10. The electronic gaming apparatus of claim 7, wherein another winning condition in the set of predetermined winning condition(s) is that the player chose to stand on the two initial playing card values and the point total of the two initial playing card values falls within the predetermined range and the player hand pushes the dealer hand.

11. The electronic gaming apparatus of claim 7, wherein the fixed paytable is based on a point total of the player hand.

12. The electronic gaming apparatus of claim 7, wherein the fixed paytable is based on a composition of the player hand.

13. The electronic gaming apparatus of claim 7, further comprising:

determining whether the point total of the player hand falls outside the predetermined range, and if so, taking the side wager.

14. The electronic gaming apparatus of claim 1, further comprising:

determining whether the point total of the player hand falls outside the predetermined range, and if so, pushing the side wager.

15. The electronic gaming apparatus of claim 1, wherein another winning condition in the set of predetermined winning condition(s) is that the player chose to stand on the two initial playing card values and a point total of the player hand falls within the predetermined range and the player hand pushes the dealer hand.

16. The electronic gaming apparatus of claim 1, further comprising:

determining whether the player hand beats the dealer hand, and if so, taking the side wager.

17. The electronic gaming apparatus of claim 1, further comprising:

determining whether the player hand beats the dealer hand, and if so, pushing the side wager.

18. The electronic gaming apparatus of claim 1, wherein if the player chooses to split the two initial playing card values during the completing into a first player hand and a second player hand then the main wager and side wager associate with the first player hand, and wherein another winning condition in the set of predetermined winning condition(s) is that the player chose to split on the two initial playing card values, the player chose to not hit on the first player hand, a point total of the first player hand falls within a predetermined range and the dealer hand beats the first player hand.

19. A method for playing an electronic version of a blackjack game comprising:

executing a program on an electronic computer used by a player, the program directing the computer to perform:

receiving a main wager and a side wager from the player;

obtaining two initial playing card values for the player from a source of playing card values;

allowing the player to choose between standing on the two initial playing card values or another option(s);

completing the blackjack game which includes resolving the main wager;

resolving the side wager, wherein in order to win the side wager the player is required to satisfy at least one winning condition in a set of predetermined winning condition(s), wherein a winning condition in the set of predetermined winning condition(s) is that the player chose to stand on the two initial playing card values and a point total of the two initial playing card values falls within a predetermined range and the player loses the main wager, and if the player did satisfy at least one winning condition in the set of predetermined winning condition (s) then the player wins a payout on the side wager.

20. A method for playing an electronic version of a blackjack game comprising:

initiating, by a player, a blackjack game on a computer;

placing, by the player using the computer, a main wager and a side wager;

viewing, by the player using the computer, two initial playing card values for the player from a source of playing card values;

choosing, by the player using the computer, between standing on the two initial playing card values or another option(s);

viewing a completion of the game, by the player using the computer, which includes determining a player hand and a dealer hand;

wherein the side wager is resolved, wherein in order to win the side wager the player is required to satisfy at least one winning condition in a set of predetermined winning condition(s), wherein a winning condition in the set of predetermined winning condition(s) is that the player chose to stand on the two initial playing card values and a point total of the two initial playing card values falls within a predetermined range and the dealer hand beats the player hand, and if the player did satisfy at least one winning condition in the set of predetermined winning condition(s) then the player wins a payout on the side wager.

21. An electronic gaming apparatus for playing a blackjack game comprising:

a computer;

a computer readable storage medium, storing instructions executable by the computer to perform the following operations after receipt of a main wager and a side wager from a player:

obtaining two initial playing card values from a source of playing card values;

allowing the player to choose between standing on the two initial playing card values or another option(s);

completing the blackjack game which includes resolving the main wager;

requiring, in order to trigger a winning payout for the side wager, that the player satisfy at least one winning condition in a set of predetermined winning condition (s), wherein a winning condition in the set of predetermined winning condition(s) is that the player chose to stand on the two initial playing card values and a point total of the two initial playing card values falls within a predetermined range and the player loses the main wager, and if the player did satisfy at least one winning condition in the set of predetermined winning condition(s) then paying the player based on the side wager and a fixed paytable;

if the player chose to hit on the two initial playing card values then taking the side wager; and if the player did choose to stand on the two initial playing card values and if the player wins the main wager, then taking the side wager.

22. An electronic gaming apparatus for playing a side wager in a blackjack game comprising:

a computer;

a computer readable storage medium, storing instructions executable by the computer to perform the following operations after receipt of a main wager and a side wager from a player:

obtaining two initial playing card values from a source of playing card values;

allowing the player to choose between standing on the two initial playing card values or another option(s);

completing the blackjack game which includes determining a player hand and a dealer hand;

requiring, in order to trigger a winning payout for the side wager, that the player satisfy at least one winning condition in a set of predetermined winning condition (s), wherein a winning condition in the set of predetermined winning condition(s) is that the player chose to stand on the two initial playing card values and a point total of the two initial playing card values falls within a predetermined range and the dealer hand beats the player hand; and if the player did satisfy at least one winning condition in the set of predetermined winning condition(s), then paying the player an award based on the side wager and a fixed paytable.

* * * * *